US009170509B2

(12) United States Patent
Masuda

(10) Patent No.: US 9,170,509 B2
(45) Date of Patent: Oct. 27, 2015

(54) TONER FOR DEVELOPING ELECTROSTATIC IMAGES

(71) Applicant: ZEON CORPORATION, Tokyo (JP)

(72) Inventor: Azusa Masuda, Tokyo (JP)

(73) Assignee: ZEON CORPORATION, Tokyo (JP)

( * ) Notice: Subject to any disclaimer, the term of this patent is extended or adjusted under 35 U.S.C. 154(b) by 0 days.

(21) Appl. No.: 14/241,408

(22) PCT Filed: Sep. 19, 2012

(86) PCT No.: PCT/JP2012/073947
§ 371 (c)(1),
(2) Date: Feb. 26, 2014

(87) PCT Pub. No.: WO2013/047296
PCT Pub. Date: Apr. 4, 2013

(65) Prior Publication Data

US 2014/0205944 A1 Jul. 24, 2014

(30) Foreign Application Priority Data

Sep. 28, 2011 (JP) ..... 2011-213160

(51) Int. Cl.
*G03G 9/08* (2006.01)
*G03G 9/097* (2006.01)
*G03G 9/087* (2006.01)

(52) U.S. Cl.
CPC ..... *G03G 9/0821* (2013.01); *G03G 9/08782* (2013.01); *G03G 9/08795* (2013.01); *G03G 9/08797* (2013.01); *G03G 9/09733* (2013.01)

(58) Field of Classification Search
CPC ..... G03G 9/09733; G03G 9/08782
USPC ..... 430/108.4
See application file for complete search history.

(56) References Cited

U.S. PATENT DOCUMENTS 5,712,072 A 1/1998 Inaba et al.
2010/0035170 A1* 2/2010 Sugimoto et al. ..... 430/108.2

FOREIGN PATENT DOCUMENTS

JP 8-297376 A 11/1996
JP 10-133412 A 5/1998
JP 2007-25082 A 2/2007
JP 2010-39195 A 2/2010
JP 2010-85909 A 4/2010
JP 2010-145553 A 7/2010
JP 2011-133753 A 7/2011
JP 2011-145458 A 7/2011

OTHER PUBLICATIONS

International Search Report dated Nov. 27, 2012 issued in corresponding application No. PCT/JP2012/073947.

* cited by examiner

*Primary Examiner* — Mark A Chapman

(74) *Attorney, Agent, or Firm* — Westerman, Hattori, Daniels & Adrian, LLP

(57) ABSTRACT

Disclosed is a toner for developing electrostatic images comprising a colored resin particle containing a binder resin, a colorant and a softening agent, and an external additive, wherein the colored resin particle contains a diester compound represented by the following general formula (1) as the softening agent, and a content of the diester compound is in the range from 1 to 15 parts by mass with respect to 100 parts by mass of the colored resin particle, and the toner has a softening temperature "Ts" of 55 to 70° C., a flow starting temperature "Tfb" of 80 to 100° C. and a glass transition temperature of 40 to 70° C. in a flow tester:

General formula (1)

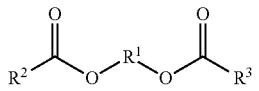

wherein, $R^1$ is an ethylene group or a trimethylene group; and each of $R^2$ and $R^3$ is independently a linear alkyl group having 11 to 25 carbons.

8 Claims, No Drawings

TONER FOR DEVELOPING ELECTROSTATIC IMAGES

TECHNICAL FIELD

The present invention relates to a toner for developing electrostatic images (hereinafter, it may be simply referred to as "toner") used for development of latent electrostatic images in electrophotography, the electrostatic recording method, the electrostatic printing method or the like.

BACKGROUND ART

In the electrophotography, a method which uses a heat roller has been widely employed in order to fix electrostatic latent images which are visualized by a toner. In this method, there has been a desire for a toner having excellent low-temperature fixability (that is, the toner has a low minimum fixing temperature) and a wide fixing temperature range.

If offset is caused on the heat roller, the fixing temperature range is referred to as the difference ($T_O$-$T_L$) between hot offset temperature ($T_O$) and the minimum fixing temperature ($T_L$). Generally, if a polymer having a low molecular weight is used as a binder resin, minimum fixing temperature decreases but hot offset temperature decreases; moreover, heat-resistant shelf stability lowers. On the other hand, if a polymer having a high molecular weight is used as a binder resin, hot offset temperature increases and heat-resistant shelf stability is improved; however, there is a problem that minimum fixing temperature increases.

There has been known a technique intended to solve the issue caused by the fact that the relationship between hot offset temperature and heat-resistant shelf stability and minimum fixing temperature is traded-off.

For example, Patent Literature 1 discloses a toner for developing electrostatic images comprising at least a binder resin, a charge control agent and a wax component, wherein a DSC curve of the wax has a predetermined endothermic peak and a half-value width, the wax component attributed to the predetermined endothermic peak of the wax is a predetermined ester wax, and a weight average particle diameter of the toner is in a predetermined range.

Patent Literature 2 discloses a toner for developing electrostatic images comprising a toner particle containing a binder resin formed by a styrene polymer or a styrene copolymer, a colorant, a polar resin and a predetermined solid wax.

Patent Literature 3 discloses a wax for a toner contained in a toner for electrophotography, comprising a first carboxylic acid ester compound having 32 to 41 carbons, a second carboxylic acid ester compound having 42 to 46 carbons and a third carboxylic acid ester compound having 47 to 62 carbons in a predetermined ratio.

CITATION LIST

Patent Literature

Patent Literature 1: Japanese Patent Application Laid-Open (JP-A) No. H10-133412
Patent Literature 2: JP-A No. H8-297376
Patent Literature 3: JP-A No. 2011-133753

SUMMARY OF INVENTION

Technical Problem

However, there is no experimental result in Patent Literatures 1 and 2, showing that the toner for developing electrostatic images disclosed in these patent literatures provides glossy appearance in a wide temperature range. Also, Patent Literature 2 does not disclose an experimental result proving that the toner for developing electrostatic images disclosed in Patent Literature 2 provides excellent shelf stability. Moreover, Patent Literature 3 does not disclose an experimental result showing that the toner using the wax disclosed in Patent Literature 3 provides glossy appearance in a wide temperature range.

An object of the present invention is to provide a toner for developing electrostatic images having excellent low-temperature fixability, hot offset resistance and heat-resistant shelf stability. Also, the present invention is to provide a toner which provides high-gloss printouts (glossy appearance) in a wide temperature range.

Solution to Problem

As a result of diligent researches to solve the above problems, the inventor of the present invention has found out that the above problems can be solved by using a specific diester compound as a softening agent and making softening temperature "Ts", flow starting temperature "Tfb" and glass transition temperature of a toner be in a specific range, respectively.

That is, according to the present invention, a toner for developing electrostatic images comprising a colored resin particle containing a binder resin, a colorant and a softening agent, and an external additive, is provided, wherein the colored resin particle contains a diester compound represented by the following general formula (1) as the softening agent, and a content of the diester compound is in the range from 1 to 15 parts by mass with respect to 100 parts by mass of the colored resin particle, and the toner has a softening temperature "Ts" of 55 to 70° C., a flow starting temperature "Tfb" of 80 to 100° C. and a glass transition temperature of 40 to 70° C. in a flow tester.

General formula (1)

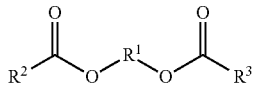

wherein, $R^1$ is an ethylene group or a trimethylene group; and each of $R^2$ and $R^3$ is independently a linear alkyl group having 11 to 25 carbons.

In the present invention, the toner may further contain a dipentaerythritol hexaester compound as the softening agent.

In the present invention, the dipentaerythritol hexaester compound may have a structure represented by the following general formula (2):

General formula (2)

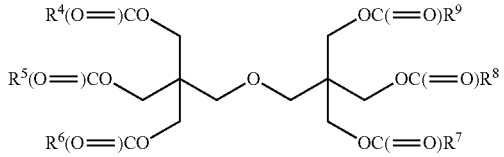

wherein, each of $R^4$ to $R^9$ is independently a linear alkyl group having 11 to 25 carbons.

It is preferable in the present invention that the colored resin particle is produced by a wet method.

In the present invention, a content ratio of the diester compound and the dipentaerythritol hexaester compound may be in the range from 20:80 to 80:20 mass % (diester compound: dipentaerythritol hexaester compound).

It is preferable in the present invention that the softening agent has an acid value of 0.01 to 2 mg KOH/g.

It is preferable in the present invention that the softening agent has a hydroxyl group value of 0.1 to 15 mg KOH/g.

Advantageous Effects of Invention

According to the toner for developing electrostatic images of the present invention, the toner contains the diester compound having a specific chemical structure, and has a specific range of softening temperature "Ts", flow starting temperature "Tfb" and glass transition temperature. Thereby, the toner has excellent heat-resistant shelf stability, low-temperature fixability and hot offset resistance, and can provide a smooth printing surface and high-gloss (glossy appearance) printouts.

DESCRIPTION OF EMBODIMENTS

The toner for developing electrostatic images comprises a colored resin particle containing a binder resin, a colorant and a softening agent, and an external additive, wherein the colored resin particle contains a diester compound represented by the following general formula (1) as the softening agent, and a content of the diester compound is in the range from 1 to 15 parts by mass with respect to 100 parts by mass of the colored resin particle, and the toner has a softening temperature "Ts" of 55 to 70° C., a flow starting temperature "Tfb" of 80 to 100° C. and a glass transition temperature of 40 to 70° C. in a flow tester.

General formula (1)

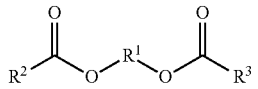

wherein, $R^1$ is an ethylene group or a trimethylene group; and each of $R^2$ and $R^3$ is independently a linear alkyl group having 11 to 25 carbons.

Hereinafter, the toner for developing electrostatic images (hereinafter may be referred to as "toner") of the present invention will be described.

The toner of the present invention contains a binder resin, a colorant, a specific softening agent and an external additive.

Hereinafter, a method for producing the colored resin particles used in the present invention, the colored resin particles obtained by the production method, a method for producing the toner of the present invention using the colored resin particles and the toner of the present invention will be described in this order.

1. Method for Producing Colored Resin Particles

Generally, methods for producing the colored resin particles are broadly classified into dry methods such as a pulverization method and wet methods such as an emulsion polymerization agglomeration method, a suspension polymerization method and a solution suspension method. The wet methods are preferable since toners having excellent printing characteristics such as image reproducibility can be easily obtained. Among the wet methods, polymerization methods such as the emulsion polymerization agglomeration method and the suspension polymerization method are preferable since toners which have relatively small particle size distribution in micron order can be easily obtained. Among the polymerization methods, the suspension polymerization method is more preferable.

The emulsion polymerization agglomeration method is a method for producing colored resin particles by polymerizing emulsified polymerizable monomers to obtain a resin microparticle emulsion, and aggregating the resultant resin microparticles with a colorant dispersion, etc. The solution suspension method is a method for producing colored resin particles by forming droplets of a solution in an aqueous medium, the solution containing toner components such as a binder resin and a colorant dissolved or dispersed in an organic solvent, and removing the organic solvent. Both methods can be performed by known methods.

The colored resin particles of the present invention can be produced by employing the wet methods or the dry methods. The suspension polymerization method preferable among the wet methods is performed by the following processes.

(A) Suspension Polymerization Method (A-1) Preparation Process of Polymerizable Monomer Composition First, a polymerizable monomer, a colorant, a softening agent, and other additives such as a charge control agent, etc., which are added if required, are mixed to prepare a polymerizable monomer composition. For example, a media type dispersing machine is used for the mixing upon preparing the polymerizable monomer composition.

In the present invention, the polymerizable monomer means a monomer having a polymerizable functional group, and the polymerizable monomer is polymerizable to be a binder resin. As a main component of the polymerizable monomer, a monovinyl monomer is preferably used. Examples of the monovinyl monomer include: styrene; styrene derivatives such as vinyl toluene and α-methylstyrene; acrylic acid and methacrylic acid; acrylic acid esters such as methyl acrylate, ethyl acrylate, propyl acrylate, butyl acrylate, 2-ethylhexyl acrylate and dimethylaminoethyl acrylate; methacrylic acid esters such as methyl methacrylate, ethyl methacrylate, propyl methacrylate, butyl methacrylate, 2-ethylhexyl methacrylate and dimethylaminoethyl methacrylate; nitrile compounds such as acrylonitrile and methacrylonitrile; amide compounds such as acrylamide and methacrylamide; and olefins such as ethylene, propylene and butylene. These monovinyl monomers may be used alone or in combination of two or more kinds. Among them, styrene, styrene derivatives, and acrylic acid esters or methacrylic acid esters are suitably used for the monovinyl monomer.

In order to improve the hot offset and shelf stability, it is preferable to use any crosslinkable polymerizable monomer together with the monovinyl monomer. The crosslinkable polymerizable monomer means a monomer having two or more polymerizable functional groups. Examples of the crosslinkable polymerizable monomer include: aromatic divinyl compounds such as divinyl benzene, divinyl naphthalene and derivatives thereof; ester compounds such as ethylene glycol dimethacrylate and diethylene glycol dimethacrylate, in which two or more carboxylic acids having a carbon-carbon double bond are esterified to alcohol having two or more hydroxyl groups; other divinyl compounds such as N,N-divinylaniline and divinyl ether; and compounds having three or more vinyl groups. These crosslinkable polymerizable monomers can be used alone or in combination of two or more kinds.

In the present invention, it is desirable that the amount of the crosslinkable polymerizable monomer to be used is generally in the range from 0.1 to 5 parts by mass, preferably from 0.3 to 2 parts by mass, with respect to 100 parts by mass of the monovinyl monomer.

Further, it is preferable to use macromonomer as part of the polymerizable monomer since the balance of the shelf stability and low-temperature fixability of the toner to be obtained can be improved. The macromonomer is a reactive oligomer or polymer having a polymerizable carbon-carbon unsaturated double bond at the end of a polymer chain and generally having a number average molecular weight of 1,000 to 30,000. A preferable macromonomer is one capable of providing a polymer having higher glass transition temperature (hereinafter may be referred to as "Tg") than a polymer obtained by the polymerization of the monovinyl monomer. The macromonomer to be used is preferably in the range from 0.03 to 5 parts by mass, more preferably from 0.05 to 1 part by mass, with respect to 100 parts by mass of the monovinyl monomer.

In the present invention, a colorant is used. To produce a color toner, a black colorant, a cyan colorant, a yellow colorant and a magenta colorant can be used.

Examples of the black colorant to be used include carbon black, titanium black and magnetic powder such as zinc-iron oxide and nickel-iron oxide.

Examples of the cyan colorant to be used include copper phthalocyanine compounds, derivatives thereof and anthraquinone compounds. The specific examples include C. I. Pigment Blue 2, 3, 6, 15, 15:1, 15:2, 15:3, 15:4, 16, 17:1 and 60.

Examples of the yellow colorant to be used include compounds including azo pigments such as monoazo pigments and disazo pigments, and condensed polycyclic pigments. The specific examples include C. I. Pigment Yellow 3, 12, 13, 14, 15, 17, 62, 65, 73, 74, 83, 93, 97, 120, 138, 155, 180, 181, 185, 186 and 213.

Examples of the magenta colorant to be used include compounds including azo pigments such as monoazo pigments and disazo pigments, and condensed polycyclic pigments. The specific examples include C. I. Pigment Red 31, 48, 57:1, 58, 60, 63, 64, 68, 81, 83, 87, 88, 89, 90, 112, 114, 122, 123, 144, 146, 149, 150, 163, 170, 184, 185, 187, 202, 206, 207, 209, 237, 238, 251, 254, 255 and 269, and C. I. Pigment Violet 19.

In the present invention, these colorants can be used alone or in combination of two or more kinds. The amount of the colorant is preferably in the range from 1 to 10 parts by mass with respect to 100 parts by mass of the monovinyl monomer.

The colored resin particle used in the present invention contains, as a softening agent, a diester compound represented by the above general formula (1).

In the above general formula (1), $R^1$ is an ethylene group (—$CH_2$—$CH_2$—) or a trimethylene group (—$CH_2$—$CH_2$—$CH_2$—), and is preferably an ethylene group.

In the above general formula (1), each of $R^2$ and $R^3$ is independently a linear alkyl group having 11 to 25 carbons. Therefore, $R^2$ and $R^3$ may be the same or different from each other. Each of $R^2$ and $R^3$ is preferably a linear alkyl group having 13 to 21 carbons, more preferably a linear alkyl group having 15 to 19 carbons, from the viewpoint of obtaining the toner having excellent low-temperature fixability (low minimum fixing temperature).

Specific examples of the diester compound represented by the above general formula (1) include ethylene glycol distearate ($R^1$=—$C_2H_4$—, $R^2$=$R^3$=—$O_{17}H_{35}$), trimethylene glycol distearate ($R^1$=—$C_3H_6$—, $R^2$=$R^3$=—$C_{17}H_{35}$), ethylene glycol arachidate stearate ($R^1$=—$C_2H_4$—, $R^2$=—$C_{19}H_{39}$, $R^3$=—$C_{17}H_{35}$), trimethylene glycol arachidate stearate ($R^1$=—$C_3H_6$—, $R^2$=—$C_{19}H_{39}$, $R^3$=—$C_{17}H_{35}$), ethylene glycol stearate palmitate ($R^1$=—$C_2H_4$—, $R^2$=—$C_{17}H_{35}$, $R^3$=—$C_{15}H_{31}$), trimethylene glycol stearate palmitate ($R^1$=—$C_3H_6$—, $R^2$=—$C_{17}H_{35}$, $R^3$=—$C_{15}H_{31}$), ethylene glycol dimyristate ($R^1$=—$C_2H_4$—, $R^2$=$R^3$=—$C_{13}H_{27}$), trimethylene glycol dimyristate ($R^1$=—$C_3H_6$—, $R^2$=$R^3$=—$C_{13}H_{27}$), ethylene glycol dipentadecanoate ($R^1$=—$C_2H_4$—, $R^2$=$R^3$=—$C_{14}H_{29}$), trimethylene glycol dipentadecanoate ($R^1$=—$C_3H_6$—, $R^2$=$R^3$=–$C_{14}H_{29}$), ethylene glycol dipalmitate ($R^1$=—$C_2H_4$—, $R^2$=$R^3$—$C_{15}H_{31}$) trimethylene glycol dipalmitate ($R^1$—$C_3H_6$—, $R^2$=$R^3$=—$C_{15}H_{31}$), ethylene glycol dimargarate ($R^1$=—$C_2H_4$—, $R^2$=$R^3$=—$C_{16}H_{33}$), trimethylene glycol dimargarate ($R^1$=–$C_3H_6$—, $R^2$=$R^3$=—$C_{16}H_{33}$), ethylene glycol dinonadecanoate ($R^1$—$C_2H_4$—, $R^2$=$R^3$—$C_{18}H_{37}$), trimethylene glycol dinonadecanoate ($R^1$—$C_3H_6$—, $R^2$=$R^3$=—$C_{18}H_{37}$), ethylene glycol diarachidate ($R^1$—$C_2H_4$—, $R^2$=$R^3$=—$C_{19}H_{39}$), trimethylene glycol diarachidate ($R^1$=—$C_3H_6$—, $R^2$=$R^3$=—$C_{19}H_{39}$), ethylene glycol dibehenate ($R^1$=—$C_2H_4$—, $R^2$=$R^3$=—$C_{21}H_{43}$) and trimethylene glycol dibehenate ($R^1$=—$C_3H_6$—, $R^2$=$R^3$—$C_{21}H_{43}$). Among the above diester compounds, more preferred are ethylene glycol distearate and trimethylene glycol distearate.

The colored resin particle used in the present invention may further contain, as a softening agent, a dipentaerythritol hexaester compound. The dipentaerythritol hexaester compound used in the present invention preferably has a structure represented by the following general formula (2).

General formula (2)

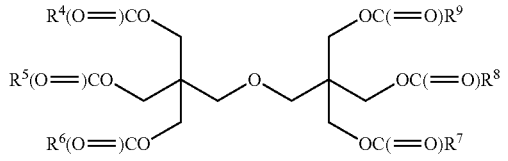

wherein, each of $R^4$ to $R^9$ is independently a linear alkyl group having 11 to 25 carbons.

In the above general formula (2), all or part of $R^4$ to $R^9$ may be the same, or all of $R^4$ to $R^9$ may be different from each other. Each of $R^4$ to $R^9$ is preferably a linear alkyl group having 13 to 21 carbons, more preferably a linear alkyl group having 15 to 19 carbons, from the viewpoint of obtaining the toner having excellent low-temperature fixability (low minimum fixing temperature).

Specific examples of the dipentaerythritol hexaester compound represented by the above general formula (2) include dipentaerythritol hexastearate ($R^4$ to $R^9$=—$C_{17}H_{35}$), dipentaerythritol triarachidate tristearate ($R^4$ to $R^6$=—$C_{19}H_{39}$, $R^7$ to $R^9$=—$C_{17}H_{35}$), dipentaerythritol tristearate tripalmitate ($R^4$ to $R^6$=—$C_{17}H_{35}$, $R^7$ to $R^9$=—$C_{15}H_{31}$) dipentaerythritol hexamyristate ($R^4$ to $R^9$=—$C_{13}H_{27}$), dipentaerythritol hexapentadecanoate ($R^4$ to $R^9$=—$C_{14}H_{29}$), dipentaerythritol hexapalmitate ($R^4$ to $R^9$=—$C_{15}H_{31}$), dipentaerythritol hexamargarate ($R^4$ to $R^9$=—$C_{16}H_{33}$), dipentaerythritol hexanonadecanoate ($R^4$ to $R^9$=—$C_{18}H_{37}$) and dipentaerythritol hexarachidate ($R^4$ to $R^9$=—$C_{19}H_{39}$). Among the above dipentaerythritol hexaester compounds, preferred are dipentaerythritol hexastearate, dipentaerythritol triarachidate tristearate and dipentaerythritol tristearate tripalmitate.

A content of the softening agent is in the range from 1 to 15 parts by mass with respect to 100 parts by mass of the colored resin particle. If two or more kinds of the softening agents are used, the total content of the softening agents is in the range from 1 to 15 parts by mass with respect to 100 parts by mass of the colored resin particle. If the content of the softening agents is less than 1 part by mass, the content is too low, so that low-temperature fixability may decrease. On the other hand, if the content of the softening agents exceeds 15 parts by mass, the content is too high, so that shelf stability may decrease.

The content of the softening agent is preferably in the range from 3 to 13 parts by mass, more preferably from 5 to 12 parts by mass, with respect to 100 parts by mass of the colored resin particle.

If the colored resin particle used in the present invention contains, as softening agents, both a diester compound and a dipentaerythritol hexaester compound, the content ratio of the diester compound and dipentaerythritol hexaester compound may be in the range from 20:80 to 80:20 mass % (diester compound: dipentaerythritol hexaester compound). If the content ratio of the diester compound is too high, low-temperature fixability may decrease. On the other hand, if the content ratio of the dipentaerythritol hexaester compound is too high, hot offset resistance may decrease.

The content ratio of the diester compound and dipentaerythritol hexaester compound is preferably in the range from 40:60 to 70:30 mass % (diester compound: dipentaerythritol hexaester compound).

The colored resin particle used in the present invention may contain, as softening agents, other kinds of ester compounds. Specific examples of other kinds of ester compounds include: pentaerythritol ester compounds such as pentaerythritol tetrabehenate, pentaerythritol tetrapalmitate and pentaerythritol tetrastearate; and glycerin ester compounds such as hexaglycerin octabehenate, pentaglycerin heptabehenate, tetraglycerin hexabehenate, triglycerin pentabehenate, diglycerin tetrabehenate and glycerintribehenate.

An acid value of the softening agent is preferably in the range from 0.01 to 2 mg KOH/g, more preferably from 0.03 to 1 mg KOH/g, further more preferably from 0.05 to 0.5 mg KOH/g. The acid value of the softening agent is a value measured with reference to JIS K 0070, using Test methods for acid value of chemical products that is enacted by Japanese Industrial Standards (JIS).

If the acid value of the softening agent exceeds the above upper limit, unreacted carboxylic acid groups derived from fatty acid are remained in the softening agent. Therefore, in the droplets forming process, it becomes difficult to form stable droplets of the polymerizable monomer composition, so that the colored resin particles have an adverse effect on characteristics of particle diameter, and a deterioration in image quality due to fog or the like is likely to occur; moreover, volatiles may be generated when the toner is fixed, thereby causing odors.

A hydroxyl group value of the softening agent is preferably in the range from 0.1 to 15 mg KOH/g, more preferably from 0.3 to 10 mg KOH/g, further more preferably from 0.5 to 5.0 mg KOH/g, particularly preferably from 1.0 to 4.0 mg KOH/g. The hydroxyl group value of the softening agent is a value measured with reference to JIS K 0070, using Test methods for hydroxyl group value of chemical products that is enacted by Japanese Industrial Standards (JIS).

If the hydroxyl group value of the softening agent exceeds the above upper limit, unreacted hydroxyl groups derived from materials are remained in the softening agent. Therefore, in the droplets forming process, it becomes difficult to form stable droplets of the polymerizable monomer composition, so that the colored resin particles have an adverse effect on characteristics of particle diameter, and a deterioration in image quality due to fog or the like is likely to occur.

Examples of the method for producing the softening agent include synthesis by oxidation reaction, synthesis from a carboxylic acid and a derivative thereof, ester group introducing reaction as typified by Michael addition reaction, a method using dehydration condensation reaction from a carboxylic acid compound and an alcohol compound, reaction from an acyl halide and an alcohol compound, an ester exchange reaction. A catalyst can be appropriately used for the production of the softening agent. As the catalyst, preferred is a general acidic or alkaline catalyst used for an esterification reaction, such as zinc acetate and a titanium compound. After the esterification reaction, a desired product may be purified by recrystallization or distillation.

The typical example of the method for producing the softening agent is as follows. The method for producing the softening agent used in the present invention is not limited to the following typical example.

First, alcohol and carboxylic acid being starting materials are added to a reactor. A molar ratio of the alcohol and carboxylic acid is appropriately adjusted in accordance with the chemical structure of an objective softening agent. For example, in the case of a diester compound, alcohol and carboxylic acid are mixed so that a molar ratio of the alcohol and carboxylic acid is 1:2. On the other hand, in the case of a dipentaerythritol hexaester compound, dipentaerythritol and carboxylic acid are mixed so that a molar ratio of the dipentaerythritol and carboxylic acid is 1:6. In consideration of reactivity in a dehydration condensation reaction, one of the alcohol and carboxylic acid may be added in slightly higher ratio than the above-mentioned ratio.

Next, thus obtained mixture is appropriately heated to perform a dehydration condensation reaction. To the esterified crude product obtained by the dehydration condensation reaction, a basic aqueous solution and an organic solvent (as needed) are added, and unreacted alcohol and carboxylic acid are deprotonated to separate water phase. Then, by appropriately performing washing with water, distilling of solvent and filtration, a desired softening agent can be obtained.

As one of other additives, a charge control agent having positively charging ability or negatively charging ability can be used to improve the charging ability of the toner.

The charge control agent is not particularly limited as long as it is generally used as a charge control agent for a toner. Among the charge control agents, a charge control resin having positively charging ability or negatively charging ability is preferably used since the charge control resin is highly compatible with the polymerizable monomer and can impart stable charging ability (charge stability) to the toner particles. From the viewpoint of obtaining a positively-chargeable toner, the charge control resin having positively charging ability is more preferably used.

Examples of the charge control agent having positively charging ability include a nigrosine dye, a quaternary ammonium salt, a triaminotriphenylmethane compound, an imidazole compound, a polyamine resin preferably used as the charge control resin, a quaternary ammonium group-containing copolymer and a quaternary ammonium salt group-containing copolymer.

Examples of the charge control agent having negatively charging ability include: azo dyes containing metal such as Cr, Co, Al and Fe; metal salicylate compounds; metal alkylsalicylate compounds; and sulfonic acid group-containing copolymers, sulfonic acid base-containing copolymers, carboxylic acid group-containing copolymers and carboxylic acid base-containing copolymers which are preferably used as charge control resins.

In the present invention, it is desirable that the amount of the charge control agent to be used is generally in the range from 0.01 to 10 parts by mass, preferably from 0.03 to 8 parts by mass, with respect to 100 parts by mass of the monovinyl monomer. If the added amount of the charge control agent is less than 0.01 part by mass, fog may occur. On the other hand, if the added amount of the charge control agent exceeds 10 parts by mass, printing soiling may occur.

As one of other additives, a molecular weight modifier is preferably used upon the polymerization of the polymerizable monomer which is polymerized to be a binder resin.

The molecular weight modifier is not particularly limited as long as it is generally used as a molecular weight modifier for a toner. Examples of the molecular weight modifier include: mercaptans such as t-dodecyl mercaptan, n-dodecyl mercaptan, n-octyl mercaptan and 2,2,4,6,6-pentamethylheptane-4-thiol; and thiuram disulfides such as tetramethyl thiuram disulfide, tetraethyl thiuram disulfide, tetrabutyl thiuram disulfide, N,N'-dimethyl-N,N'-diphenyl thiuram disulfide and N,N'-dioctadecyl-N,N'-diisopropyl thiuram disulfide. These molecular weight modifiers may be used alone or in combination of two or more kinds.

In the present invention, it is desirable that the amount of the molecular weight modifier to be used is generally in the range from 0.01 to 10 parts by mass, more preferably from 0.1 to 5 parts by mass, with respect to 100 parts by mass of the monovinyl monomer.

(A-2) Suspension Process of Obtaining Suspension (Droplets Forming Process)

In the present invention, the polymerizable monomer composition comprising at least a polymerizable monomer, a colorant and a softening agent is dispersed in an aqueous medium containing a dispersion stabilizer, and a polymerization initiator is added therein. Then, the droplets of the polymerizable monomer composition are formed. The method for forming droplets is not particularly limited. The droplets are formed by means of a device capable of strong stirring such as an in-line type emulsifying and dispersing machine (product name: MILDER; manufactured by Ebara Corporation), and a high-speed emulsification dispersing machine (product name: T. K. HOMOMIXER MARK II; manufactured by PRIMIX Corporation).

Examples of the polymerization initiator include: persulfates such as potassium persulfate and ammonium persulfate; azo compounds such as 4,4'-azobis(4-cyanovaleric acid), 2,2'-azobis(2-methyl-N-(2-hydroxyethyl)propionamide), 2,2'-azobis(2-amidinopropane)dihydrochloride, 2,2'-azobis (2,4-dimethylvaleronitrile) and 2,2'-azobisisobutyronitrile; and organic peroxides such as di-t-butylperoxide, benzoylperoxide, t-butylperoxy-2-ethylhexanoate, t-hexylperoxy-2-ethylbutanoate, diisopropylperoxydicarbonate, di-t-butylperoxyisophthalate and t-butylperoxyisobutyrate. These can be used alone or in combination of two or more kinds. Among them, the organic peroxides are preferably used since they can reduce residual polymerizable monomer and can impart excellent printing durability.

Among the organic peroxides, preferred are peroxy esters, and more preferred are non-aromatic peroxy esters, i.e. peroxy esters having no aromatic ring, since they have excellent initiator efficiency and can reduce a residual polymerizable monomer.

The polymerization initiator may be added after dispersing the polymerizable monomer composition to the aqueous medium and before forming droplets as described above, or may be added to the polymerizable monomer composition before the polymerizable monomer composition is dispersed in the aqueous medium.

The added amount of the polymerization initiator used in the polymerization of the polymerizable monomer composition is preferably in the range from 0.1 to 20 parts by mass, more preferably from 0.3 to 15 parts by mass, even more preferably from 1 to 10 parts by mass, with respect to 100 parts by mass of the monovinyl monomer.

In the present invention, the aqueous medium means a medium containing water as a main component.

In the present invention, the dispersion stabilizer is preferably added to the aqueous medium. Examples of the dispersion stabilizer include: inorganic compounds including sulfates such as barium sulfate and calcium sulfate; carbonates such as barium carbonate, calcium carbonate and magnesium carbonate; phosphates such as calcium phosphate; metal oxides such as aluminum oxide and titanium oxide; and metal hydroxides such as aluminum hydroxide, magnesium hydroxide and iron(II) hydroxide; and organic compounds including water-soluble polymers such as polyvinyl alcohol, methyl cellulose and gelatin; anionic surfactants; nonionic surfactants; and ampholytic surfactants. These dispersion stabilizers can be used alone or in combination of two or more kinds.

Among the above dispersion stabilizers, colloid of inorganic compounds, particularly hardly water-soluble metal hydroxide, is preferable. By using the colloid of inorganic compounds, particularly hardly water-soluble metal hydroxide, the colored resin particles can have a small particle size distribution, so that the amount of the dispersion stabilizer remained after washing is small, thus the image can be clearly reproduced by the toner to be obtained; moreover, environmental stability can be excellent.

(A-3) Polymerization Process

After the droplets are formed as described in the above (A-2), thus obtained aqueous dispersion medium is heated to polymerize. Thereby, an aqueous dispersion of colored resin particles is formed.

The polymerization temperature of the polymerizable monomer composition is preferably 50° C. or more, more preferably in the range from 60 to 95° C. The polymerization reaction time is preferably in the range from 1 to 20 hours, more preferably in the range from 2 to 15 hours.

The colored resin particle may be used as a polymerized toner obtained by adding an external additive. It is preferable that the colored resin particle is so-called core-shell type (or "capsule type") colored resin particle which is obtained by using the colored resin particle as a core layer and forming a shell layer, a material of which is different from that of the core layer, around the core layer. The core-shell type colored resin particles can take a balance of lowering fixing temperature and prevention of blocking at storage, since the core layer including a substance having a low softening point is covered with a substance having a higher softening point.

A method for producing the above-mentioned core-shell type colored resin particles using the colored resin particles is not particularly limited, and can be produced by any conventional method. The in situ polymerization method and the phase separation method are preferable from the viewpoint of production efficiency.

A method for producing the core-shell type colored resin particles according to the in situ polymerization method will be hereinafter described.

A polymerizable monomer for forming a shell layer (a polymerizable monomer for shell) and a polymerization initiator are added to an aqueous medium to which the colored resin particles are dispersed followed by polymerization, thus the core-shell type colored resin particles can be obtained.

As the polymerizable monomer for shell, the above-mentioned polymerizable monomer can be similarly used. Among the polymerizable monomers, any of monomers which provide a polymer having Tg of more than 80° C. such as styrene, acrylonitrile and methyl methacrylate is preferably used alone or in combination of two or more kinds.

Examples of the polymerization initiator used for polymerization of the polymerizable monomer for shell include: water-soluble polymerization initiators including metal persulfates such as potassium persulfate and ammonium persulfate; and azo-type initiators such as 2,2'-azobis(2-methyl-N-(2-hydroxyethyl)propionamide) and 2,2'-azobis(2-methyl-N-(1,1-bis(hydroxymethyl)-2-hydroxyethyl)propionamide). These polymerization initiators can be used alone or in combination of two or more kinds. The amount of the polymerization initiator is preferably in the range from 0.1 to 30 parts by mass, more preferably from 1 to 20 parts by mass, with respect to 100 parts by mass of the polymerizable monomer for shell.

The polymerization temperature of the shell layer is preferably 50° C. or more, more preferably in the range from 60 to 95° C. The polymerization reaction time is preferably in the range from 1 to 20 hours, more preferably from 2 to 15 hours.

(A-4) Processes of Washing, Filtering, Dehydrating and Drying

It is preferable that the aqueous dispersion of the colored resin particles obtained by the polymerization is subjected to operations including filtering, washing for removing the dispersion stabilizer, dehydrating, and drying several times as needed after the polymerization, according to any conventional method.

In the washing method, if the inorganic compound is used as the dispersion stabilizer, it is preferable that acid or alkali is added to the aqueous dispersion of colored resin particles; thereby, the dispersion stabilizer is dissolved in water and removed. If colloid of hardly water-soluble inorganic hydroxide is used as the dispersion stabilizer, it is preferable to control pH of the aqueous dispersion of colored resin particles to 6.5 or less. Examples of the acid to be added include inorganic acids such as sulfuric acid, hydrochloric acid and nitric acid, and organic acids such as formic acid and acetic acid. Particularly, sulfuric acid is suitable for high removal efficiency and small impact on production facilities.

The methods for dehydrating and filtering are not particularly limited, and any of various known methods can be used. Examples of the filtration method include a centrifugal filtration method, a vacuum filtration method and a pressure filtration method. Also, the drying method is not particularly limited, and any of various methods can be used.

(B) Pulverization method

In the case of producing the colored resin particles by employing the pulverization method, the following processes are performed.

First, a binder resin, a colorant, a softening agent and other additives such as a charge control agent, etc., which are added if required, are mixed by means of a mixer such as a ball mill, a V type mixer, Henschel Mixer (product name), a high-speed dissolver, an internal mixer or a whole burg. Next, the above-obtained mixture is kneaded while heating by means of a press kneader, a twin screw kneading machine or a roller. The obtained kneaded product is coarsely pulverized by means of a pulverizer such as a hammer mill, a cutter mill or a roller mill, followed by finely pulverizing by means of a pulverizer such as a jet mill or a high-speed rotary pulverizer, and classifying into desired particle diameters by means of a classifier such as a wind classifier or an airflow classifier. Thus, colored resin particles produced by the pulverization method can be obtained.

The binder resin, the colorant, the softening agent and other additives such as the charge control agent, etc., which are added if required, used in "(A) Suspension polymerization method" can be used in the pulverization method. Similarly as the colored resin particles obtained by "(A) Suspension polymerization method", the colored resin particles obtained by the pulverization method can also be in a form of the core-shell type colored resin particles produced by a method such as the in situ polymerization method.

As the binder resin, other resins which are conventionally and broadly used for toners can be used. Specific examples of the binder resin used in the pulverization method include polystyrene, styrene-butyl acrylate copolymers, polyester resins and epoxy resins.

2. Colored Resin Particles

The colored resin particles are obtained by the above production method such as (A) Suspension polymerization method or (B) Pulverization method.

Hereinafter, the colored resin particles constituting the toner will be described. The colored resin particles hereinafter include both core-shell type colored resin particles and colored resin particles which are not core-shell type.

The volume average particle diameter (Dv) of the colored resin particles is preferably in the range from 4 to 12 μm, more preferably from 5 to 10 μm. If the volume average particle diameter (Dv) of the colored resin particles is less than 4 μm, the flowability of the polymerized toner may lower, the transferability may deteriorate, and the image density may decrease. If the volume average particle diameter (Dv) of the colored resin particles exceeds 12 μm, the resolution of images may decrease.

As for the colored resin particles, a ratio (particle size distribution (Dv/Dn)) of the volume average particle diameter (Dv) and the number average particle diameter (Dn) is preferably in the range from 1.0 to 1.3, more preferably from 1.0 to 1.2. If "Dv/Dn" exceeds 1.3, the transferability, image density and resolution may decrease. The volume average particle diameter and the number average particle diameter of the colored resin particles can be measured, for example, by means of a particle diameter measuring device (product name: MULTISIZER; manufactured by Beckman Coulter, Inc.), etc.

The average circularity of the colored resin particles of the present invention is preferably in the range from 0.96 to 1.00, more preferably from 0.97 to 1.00, even more preferably from 0.98 to 1.00, from the viewpoint of image reproducibility.

If the average circularity of the colored resin particles is less than 0.96, the reproducibility of thin lines may decrease.

In the present invention, circularity is a value obtained by dividing a perimeter of a circle having an area same as a projected area of a particle by a perimeter of a projected particle image. Also, in the present invention, an average circularity is used as a simple method of quantitatively presenting shapes of particles and is an indicator showing the level of convexo-concave shapes of the colored resin particles. The average circularity is "1" when each of the colored resin particles is an absolute sphere, and the value becomes smaller as the shape of the surface of each of the colored resin particles becomes more complex.

3. Method for Producing Toner of the Present Invention

In the present invention, the colored resin particles are mixed and agitated together with an external additive; thus, the external additive is attached on the surface of the colored resin particles to form a one-component toner (developer).

The one-component toner may be mixed and agitated together with carrier particles to form a two-component developer.

The agitator for adding an external additive to colored resin particles is not particularly limited as long as it is an agitator capable of attaching the external additive on the surface of the colored resin particles. The examples include agitators capable of mixing and agitating, such as FM Mixer (product name; manufactured by NIPPON COKE & ENGINEERING CO., LTD.), SUPER MIXER (product name; manufactured by KAWATA Manufacturing Co., Ltd.), Q MIXER (product name; manufactured by NIPPON COKE & ENGINEERING CO., LTD.), Mechanofusion system (product name; manufactured by Hosokawa Micron Corporation) and MECHANOMILL (product name; manufactured by Okada Seiko Co., Ltd.). The external additive can be added to the colored resin particles by means of the above agitators.

Examples of the external additive include: inorganic particles comprising silica, titanium oxide, aluminum oxide, zinc oxide, tin oxide, calcium carbonate, calcium phosphate and/or cerium oxide; and organic particles comprising polymethyl methacrylate, silicone resin and/or melamine resin. Among them, inorganic particles are preferable. Among the inorganic particles, silica and/or titanium oxide is preferable, and particles comprising silica are more preferable.

These external additives are used alone, or in combination of two or more kinds. In particular, it is preferable to use two or more kinds of silica having a different particle diameter in a combination.

In the present invention, it is desirable that the amount of the external additive to be used is generally in the range from 0.05 to 6 parts by mass, preferably from 0.2 to 5 parts by mass, with respect to 100 parts by mass of the colored resin particles. If the added amount of the external additive is less than 0.05 part by mass, the toner after transfer may be remained. If the added amount of the external additive exceeds 6 parts by mass, fog may occur.

4. Toner of the Present Invention

The softening temperature "Ts" of the toner of the present invention in a flow tester is in the range from 55 to 70° C. If the softening temperature "Ts" of the toner in the flow tester is less than 55° C., the shelf stability may decrease. On the other hand, if the softening temperature "Ts" exceeds 70° C., the low-temperature fixability may decrease (minimum fixing temperature may increase).

The softening temperature "Ts" of the toner of the present invention in the flow tester is preferably in the range from 57 to 67° C., more preferably from 60 to 65° C. The softening temperature "Ts" can be controlled by the composition of a polymerizable monomer, the amount of a polymerization initiator and the amount of a molecular weight modifier.

The flow starting temperature "Tfb" of the toner of the present invention in a flow tester is in the range from 80 to 100° C. If the flow starting temperature "Tfb" of the toner in the flow tester is less than 80° C., the hot offset resistance may decrease (hot offset temperature may decrease). On the other hand, if the flow starting temperature "Tfb" exceeds 100° C., gloss (glossy appearance) of printouts may decrease.

The flow starting temperature "Tfb" of the toner of the present invention in the flow tester is preferably in the range from 83 to 97° C., more preferably from 85 to 95° C. The flow starting temperature "Tfb" can be controlled by the composition of a polymerizable monomer (especially, the amount of a crosslinkable monomer), the amount of a polymerization initiator and the amount of a molecular weight modifier.

The glass transition temperature of the toner of the present invention is in the range from 40 to 70° C. If the glass transition temperature is less than 40° C., the shelf stability may decrease. On the other hand, if the glass transition temperature exceeds 70° C., the low-temperature fixability may decrease (minimum fixing temperature may increase).

The glass transition temperature of the toner of the present invention is preferably in the range from 45 to 60° C., more preferably from 50 to 55° C. The glass transition temperature can be controlled by the composition of a polymerizable monomer, the amount of a polymerization initiator and the amount of a molecular weight modifier.

The softening temperature "Ts" and flow starting temperature "Tfb" of the toner in the flow tester can be calculated from the melt viscosity measured by means of the flow tester. In particular, the melt viscosity is measured by means of a flow tester (product name: CFT-500C; manufactured by SHIMADZU CORPORATION) under the conditions of a predetermined starting temperature, a heating rate, a preheating time and shear stress, and then, the softening temperature "Ts" and flow starting temperature "Tfb" of the toner can be calculated from thus obtained melt viscosity.

The glass transition temperature of the toner can be measured with reference to ASTM D3418-82. More specifically, a sample is heated at a heating rate of 10° C./minute by means of Differential Scanning calorimetry (product name: SSC5200; manufactured by SEICO Electronics industrial Co., Ltd.), and the glass transition temperature can be measured by a DSC curve obtained through the above heating process.

The toner of the present invention contains a diester compound having a specific chemical structure, and has a specific range of softening temperature "Ts", flow starting temperature "Tfb" and glass transition temperature. Thereby, the toner has excellent heat-resistant shelf stability, low-temperature fixability and hot offset resistance, and can provide a smooth printing surface and high-gloss (glossy appearance) printouts.

EXAMPLES

Hereinafter, the present invention will be described further in detail with reference to examples and comparative examples. However, the scope of the present invention may not be limited to the following examples. Herein, "part(s)" and "%" are based on mass if not particularly mentioned.

Test methods used in the examples and the comparative examples are as follows.

1. Production of Softening Agent

Production Example 1

To a four-neck flask provided with a thermometer, a nitrogen inlet, an agitator and a condenser, 312.9 g (1.1 mol) of stearic acid and 31 g (0.5 mol) of ethylene glycol were added and reacted for 15 hours at an ordinary pressure while distilling the reaction water at 180° C. under nitrogen flow. To thus obtained 100 parts esterified crude product, 20 parts toluene and 4 parts ethanol were added, and 10% aqueous solution of potassium hydroxide containing potassium hydroxide, the amount of which corresponding to 1.5 times the acid value of the esterified crude product, was further added. Then, the mixture was agitated for 30 minutes at 70° C. After the agitation, the resultant was left for 30 minutes, and a water phase (base layer) separated from the ester phase was removed, then the esterified crude product was washed with water. The water washing was repeated for 4 times until the pH of the water phase was 7. The solvent was distilled from the ester phase washed with water at 180° C. under reduced pressure of 1 kPa and subjected to a filtration, thereby obtaining softening agent A (ethylene glycol distearate). The acid value of thus obtained softening agent A was 0.1 mg KOH/g, and the hydroxyl group value of thus obtained softening agent A was 2.6 mg KOH/g.

The chemical structure of softening agent A is shown in the following formula (1A).

Formula (1A)

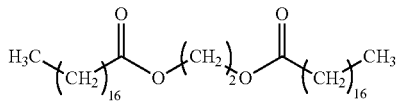

Production Example 2

Softening agent B (dipentaerythritol hexastearate) was obtained similarly as Production example 1 except that 31 g of ethylene glycol was changed to 43.2 g (0.17 mol) of dipentaerythritol. The acid value and hydroxyl group value of the obtained softening agent B were 0.1 mg KOH/g and 3.8 mg KOH/g, respectively.

The chemical structure of softening agent B is shown in the following formula (2B).

Formula (2B)

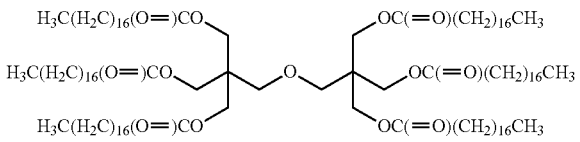

Production Example 3

Softening agent C (1,4-butanediol distearate) was obtained similarly as Production example 1 except that 31 g of ethylene glycol was changed to 45.1 g (0.5 mol) of 1,4-butanediol. The acid value and hydroxyl group value of the obtained softening agent C were 0.1 mg KOH/g and 3.2 mg KOH/g, respectively.

The chemical structure of softening agent C is shown in the following formula (1C).

Formula (1C)

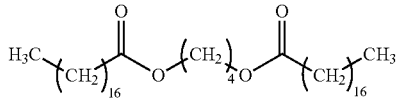

Production Example 4

Softening agent D (1,6-hexanediol distearate) was obtained similarly as Production example 1 except that 31 g of ethylene glycol was changed to 59.1 g (0.5 mol) of 1,6-hexanediol. The acid value and hydroxyl group value of the obtained softening agent D were 0.1 mg KOH/g and 3.5 mg KOH/g, respectively.

The chemical structure of softening agent D is shown in the following formula (1D).

Formula (1D)

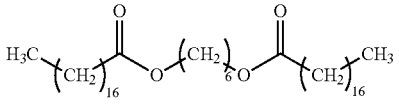

Production Example 5

Softening agent E (distearyl succinate) was obtained similarly as Production example 1 except that 312.9 g of stearic acid was changed to 118.1 g (1 mol) of succinic acid, and 31 g of ethylene glycol was changed to 148.7 g (0.55 mol) of stearyl alcohol. The acid value and hydroxyl group value of the obtained softening agent E were 0.1 mg KOH/g and 4.7 mg KOH/g, respectively.

The chemical structure of softening agent E is shown in the following formula (1E).

Formula (1E)

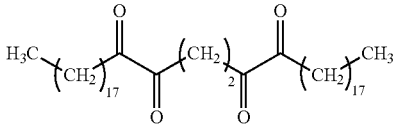

Production Example 6

Softening agent F (ethylene glycol dibehenate) was obtained similarly as Production example 1 except that 312.9 g of stearic acid was changed to 374.6 g (1.1 mol) of behenic acid. The acid value and hydroxyl group value of the obtained softening agent F were 0.1 mg KOH/g and 3.0 mg KOH/g, respectively.

The chemical structure of softening agent F is shown in the following formula (1F).

Formula (1F)

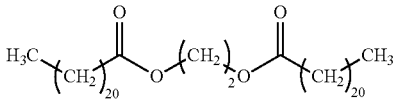

2. Evaluation of Softening Agent

The acid value and hydroxyl group value of each of softening agents A to F and a glycerin ester compound (product name: WEP7; manufactured by NOF Corporation, hereinafter may be referred to as softening agent G) were measured with reference to JIS K 0070.

The measurement results of softening agents A to F are shown in the following Table 1, together with the materials of the softening agents. The acid value and hydroxyl group value of softening agent G were 0.5 mg KOH/g and 4.8 mg KOH/g, respectively.

TABLE 1

| | | Softening agent A | Softening agent B | Softening agent C |
|---|---|---|---|---|
| Material | Alcohol | Ethylene glycol | Dipentaerythritol | 1,4-butanediol |
| | Fatty acid | Stearic acid | Stearic acid | Stearic acid |
| Acid value (mg KOH/g) | | 0.1 | 0.1 | 0.1 |
| Hydroxyl group value (mg KOH/g) | | 2.6 | 3.8 | 3.2 |

| | | Softening agent D | Softening agent E | Softening agent F |
|---|---|---|---|---|
| Material | Alcohol | 1,6-hexanediol | Stearyl alcohol | Ethylene glycol |
| | Fatty acid | Stearic acid | Succinic acid | Behenic acid |
| Acid value (mg KOH/g) | | 0.1 | 0.1 | 0.1 |
| Hydroxyl group value (mg KOH/g) | | 3.5 | 4.7 | 3.0 |

3. Production of Toner for Developing Electrostatic Images

Example 1

75 parts styrene and 25 parts n-butyl acrylate as monovinyl monomers, 7 parts carbon black (product name: #25B; manufactured by Mitsubishi Chemical Corporation) as a black colorant, 0.60 part divinylbenzene as a crosslinkable polymerizable monomer, 1.0 part t-dodecyl mercaptan as a molecular weight modifier and 0.25 part polymethacrylic acid ester macromonomer (product name: AA6; manufactured by Toagosei Co., Ltd.) as a macromonomer were wet-pulverized by means of a media type wet pulverizer. Thereto, 1 part charge control resin having positively charging ability (quaternary ammonium group-containing styrene/acrylic copolymer) as a charge control agent, 10 parts softening agent A produced in Production example 1 as a softening agent were added and mixed. Thus, a polymerizable monomer composition was obtained.

Separately, in an agitating chamber, an aqueous solution of 4.1 parts sodium hydroxide dissolved in 50 parts ion-exchanged water was gradually added to an aqueous solution of 7.4 parts magnesium chloride dissolved in 250 parts ion-exchanged water at room temperature while agitating to prepare a magnesium hydroxide colloid dispersion (3.0 parts magnesium hydroxide).

The polymerizable monomer composition was charged into the above-obtained magnesium hydroxide colloid dispersion and agitated at 25° C. until the droplets were stable. Then, 5 parts t-butylperoxy-2-ethylhexanoate (product name: PERBUTYL 0; manufactured by NOF Corporation) as a polymerization initiator was added therein followed by being subjected to a high shear agitation at 15,000 rpm by means of an in-line type emulsifying and dispersing machine (product name: EBARA MILDER; manufactured by Ebara Corporation). Thus, droplets of the polymerizable monomer composition were formed.

The suspension having the above-obtained droplets of the polymerization monomer composition dispersed (a polymerizable monomer composition dispersion) was charged into a reactor furnished with an agitating blade and the temperature thereof was raised to 90° C. to start a polymerization reaction. When the polymerization conversion reached almost 100%, 1.5 parts methyl methacrylate (a polymerizable monomer for shell) and 0.15 part 2,2'-azobis (2-methyl-N-(2-hydroxyethyl)-propionamide) (a polymerization initiator for shell; product name: VA-086; manufactured by Wako Pure Chemical Industries, Ltd.; water-soluble) dissolved in 20 parts ion-exchanged water were added in the reactor. After continuing the polymerization for another 3 hours at 90° C., the reactor was cooled by water to stop the reaction. Thus, an aqueous dispersion of colored resin particles was obtained.

The above-obtained aqueous dispersion of colored resin particles was subjected to acid washing, in which sulfuric acid was added dropwise to be pH of 6.5 or less while agitating at 25° C. Then, separation by filtration was performed, and thus a solid content was obtained. After 500 parts ion-exchanged water was added to the solid content to make a slurry again, a water washing treatment (washing, filtration and dehydration) was performed several times. Next, separation by filtration was performed and the thus-obtained solid content was placed in a container of a dryer for drying at 45° C. for 48 hours. Thus, dried colored resin particles were obtained.

To 100 parts of the above-obtained colored resin particles, 0.7 part of silica particles A having a number average primary particle diameter of 10 nm and 1 part of silica particles B having a number average primary particle diameter of 55 nm, which are hydrophobized with amino modified silicone oil were added to mix by means of a high speed agitator (product name: Henschel Mixer; manufactured by NIPPON COKE & ENGINEERING CO., LTD.), and the external additives were externally added. Thus, a toner for developing electrostatic images of Example 1 was produced.

Example 2

A toner for developing electrostatic images of Example 2 was produced similarly as in Example 1 except that 5 parts softening agent A and 5 parts softening agent B were added instead of 10 parts softening agent A.

Example 3

A toner for developing electrostatic images of Example 3 was produced similarly as in Example 1 except that 6.5 parts softening agent A and 3.5 parts softening agent B were added instead of 10 parts softening agent A.

Example 4

A toner for developing electrostatic images of Example 4 was produced similarly as in Example 1 except that 5 parts softening agent A and 5 parts glycerin ester compound (softening agent G) were added instead of 10 parts softening agent A.

Example 5

A toner for developing electrostatic images of Example 5 was produced similarly as in Example 1 except that 5 parts softening agent F and 5 parts softening agent B were added instead of 10 parts softening agent A.

Comparative Example 1

A toner for developing electrostatic images of Comparative example 1 was produced similarly as in Example 1 except that 10 parts softening agent C was added instead of 10 parts softening agent A.

Comparative Example 2

A toner for developing electrostatic images of Comparative example 2 was produced similarly as in Example 1 except that 10 parts glycerin ester compound (softening agent G) was added instead of 10 parts softening agent A.

Comparative Example 3

A toner for developing electrostatic images of Comparative example 3 was produced similarly as in Example 1 except that 5 parts softening agent C and 5 parts glycerin ester compound (softening agent G) were added instead of 10 parts softening agent A.

Comparative Example 4

A toner for developing electrostatic images of Comparative example 4 was produced similarly as in Example 1 except that 5 parts softening agent D and 5 parts glycerin ester compound (softening agent G) were added instead of 10 parts softening agent A.

Comparative Example 5

A toner for developing electrostatic images of Comparative example 5 was produced similarly as in Example 1 except that 10 parts softening agent B was added instead of 10 parts softening agent A.

Comparative Example 6

A toner for developing electrostatic images of Comparative example 6 was produced similarly as in Example 1 except that 5 parts softening agent E and 5 parts glycerin ester compound (softening agent G) were added instead of 10 parts softening agent A.

4. Property Evaluation of Toner and Colored Resin Particles

The characteristics of the toner for developing electrostatic images of Examples 1 to 5 and Comparative examples 1 to 5, and the colored resin particles used for the toner production were examined. The details are as follows. The toner of Comparative example 6 was not examined as the fusion was caused upon the toner production.

4-1. Measurement of Volume Average Particle Diameter (Dv) and Number Average Particle Diameter (Dn), and Calculation of Particle Size Distribution (Dv/Dn)

About 0.1 g of colored resin particles was weighed out and placed in a beaker. Then, 0.1 mL aqueous solution of alkyl benzene sulfonate (product name: DRIWEL; manufactured by FUJIFILM Corporation) was added therein as a dispersant. Further, from 10 to 30 mL of an electrolyte solution for measurement (product name: ISOTON II-PC; manufactured by Beckman Coulter, Inc.) was added to the beaker and dispersed by means of an ultrasonic disperser at 20 W (watts) for 3 minutes. Then, the volume average particle diameter (Dv) and number average particle diameter (Dn) of the colored resin particles were measured by means of a particle diameter measuring device (product name: MULTISIZER; manufactured by Beckman Coulter, Inc.) under the condition of an aperture diameter of 100 μm, using ISOTON II-PC as a medium, and a number of the measured particles of 100,000. Therefrom, the particle size distribution (Dv/Dn) was calculated. The measurement and calculation results are shown in the following Table 2.

4-2. Property Evaluation of Toner

The softening temperature "Ts" and flow starting temperature "Tfb" of the toner were measured by the following method.

First, a toner was measured by the following conditions by means of a flow tester (product name: CFT-500C; manufactured by SHIMADZU CORPORATION).

Starting temperature=35° C.
Heating rate=3° C./minute
Preheating time=5 minutes
Cylinder pressure=10.0 kg·f/cm$^2$
Die diameter=0.5 mm
Die length=1.0 mm
Shear stress=2.451×10$^5$ Pa
Amount of materials to be charged=1.0 to 1.3 g Next, the softening temperature "Ts" and flow starting temperature "Tfb" of the toner were calculated from the measurement results. Calculation results are shown in the following Table 2.

The glass transition temperature of the toner was measured by the following method.

The maximum endothermic peak temperature of the toner was measured with reference to ASTM D3418-82. Specifically, a toner sample was heated at a heating rate of 10° C./minute by means of Differential Scanning calorimetry (product name: SSC5200; manufactured by SEICO Electronics industrial Co., Ltd.), and the temperature which shows the glass transition temperature in a DSC curve obtained through the above heating process was measured. The measurement result is shown in the following Table 2.

5. Evaluation of Colored Resin Particles and Toner for Developing Electrostatic Images The characteristics of the toner for developing electrostatic images of Examples 1 to 5 and Comparative examples 1 to 5 were examined. The details are as follows.

5-1. Evaluation of Shelf Stability 10 g of a toner was placed in a sealable polyethylene container (capacity: 100 mL), and the container was sealed. Then, the container was set in a constant temperature water bath which is maintained at a temperature of 55° C. After 8 hours, the container was removed from the constant temperature water bath, and the toner in the container was put on a 42-mesh sieve. At this time, the toner was gently removed from the container and carefully put on the sieve so as not to destroy the aggregation structure of the toner in the container.

The sieve on which the toner was put was vibrated for 30 seconds under the condition of amplitude of 1 mm by means of a powder characteristic tester (product name: POWDER TESTER PT-R; manufactured by Hosokawa Micron Corporation). Thereafter, the mass of the toner remained on the sieve was measured, and the thus-measured toner was referred to as an aggregated toner mass. The ratio (% by mass) of the aggregated toner mass to the toner mass which was firstly placed in the container was calculated.

The above measurement was performed three times per sample to calculate the ratio (% by mass) of the aggregated toner mass, and the mean value of thus obtained ratio was referred to as an indicator of shelf stability.

5-2. Measurement of Minimum Fixing Temperature and Hot Offset Temperature

A commercially available printer of the non-magnetic one-component developing method, which was refurbished so that the temperature of a fixing roller of the printer was changed, was used for a fixing test. 100 g of a toner was charged in a toner cartridge of a development device of the printer and printing paper was set in the printer. The fixing test was performed as described below.

In the fixing test, a solid patterned image with 100% printing density was printed, the temperature of the fixing roller in the refurbished printer was changed by 5° C., and then the fixing rate of the toner was measured at each temperature to determine the relationship between the temperature and fixing rate.

At each temperature changed by 5° C., the temperature was kept for 5 minutes or more in order to stabilize the temperature of the fixing roller.

A tape was removed in the area of the solid patterned image with 100% printing density. The fixing rate was calculated from the ratio of image density before and after removing the tape. In particular, if the image density before removing the tape is referred to as ID (before) and the image density after removing the tape is referred to as ID (after), the fixing rate can be calculated from the following formula:

Fixing rate (%)=(ID (after)/ID (before))×100

Tape removing operation means a series of operations including: attaching an adhesive tape (product name: SCOTCH MENDING TAPE 810-3-18; manufactured by Sumitomo 3M Limited) to a measuring part of a test paper to be adhered by pressure by means of a disk-shaped metal roller (diameter 15 cm×thickness 2 cm; weight: 1 kg) at a constant pressure; and removing the adhesive tape in a direction along the paper at a constant rate. The image density was measured by means of a reflection image densitometer (product name: RD914; manufactured by Gretag Macbeth Co.).

In the above fixing test, the minimum fixing roller temperature at which the fixing rate is 80% or more was referred to as the minimum fixing temperature of the toner. In addition, hot offset temperature is the temperature at which residual fouling resulted from the toner by offset was confirmed on the fixing roller as a result of raising the temperature by 5° C. The test of hot offset was performed up to 230° C. In Table 2, "230<" means that hot offset was not caused even at 230° C.

5-3. Gloss Evaluation

The printer was adjusted so that the amount of toner on a paper with solid images becomes 0.45 (mg/cm$^2$), and then 5 cm square solid images were printed on a paper (product name: Laser Print Paper 24; manufactured by Hammer Mill) by changing the temperature (fixing temperature) of the fixing roller by 10° C. in the range from 170 to 200° C. The gloss value of the thus-obtained 5 cm square solid images was measured by means of a gloss meter (product name: VGS-SENSOR; manufactured by Nippon Denshoku Industries Co., Ltd.) at an incident angle of 60°. The higher the gloss value, the higher the glossy appearance.

The measurement and evaluation results of the toner for developing electrostatic images of Examples 1 to 5 and Comparative examples 1 to 6 are shown in Table 2, together with the kind and the content of each of the softening agents. In the following Table 2, "softening agent 1" and "softening agent 2" are named for convenience, and they do not particularly mean the priority and sequence of addition of the softening agents.

TABLE 2

| | | Example 1 | Example 2 | Example 3 | Example 4 | Example 5 |
|---|---|---|---|---|---|---|
| Softening agent | Type of Softening agent 1 | Softening agent A | Softening agent A | Softening agent A | Softening agent A | Softening agent F |
| | Amount (part) of Softening agent 1 | 10 | 5 | 6.5 | 5 | 5 |
| | Type of Softening agent 2 | | Softening agent B | Softening agent B | Softening agent G | Softening agent B |
| | Amount (part) of Softening agent 2 | | 5 | 3.5 | 5 | 5 |
| Characteristics of colored resin particles and toner | Volume average particle diameter Dv (μm) | 7.5 | 7.5 | 7.5 | 7.5 | 7.5 |
| | Particle size distribution (Dv/Dn) | 1.15 | 1.12 | 1.13 | 1.13 | 1.14 |
| | Softening temperature Ts (° C.) | 60 | 60 | 60 | 60 | 61 |
| | Flow starting temperature Tfb (° C.) | 85 | 95 | 90 | 95 | 96 |
| | Glass transition temperature (° C.) | 50 | 52 | 51 | 52 | 52 |
| Toner Evaluation | Shelf stability (%) | 0.1 | 0.3 | 0.3 | 2.0 | 0.1 |
| | Minimum fixing temperature (° C.) | 130 | 135 | 140 | 140 | 140 |
| | Hot offset temperature (° C.) | 180 | 210 | 220 | 230< | 230< |
| | Gloss 170° C. | 10.2 | 7.2 | 7.7 | 7.0 | 9.0 |
| | 180° C. | 10.8 | 7.8 | 8.4 | 7.5 | 9.5 |
| | 190° C. | 10.8 | 8.0 | 8.6 | 7.8 | 10.2 |
| | 200° C. | 9.5 | 7.8 | 8.2 | 7.8 | 9.7 |

| | | Comparative Example 1 | Comparative Example 2 | Comparative Example 3 | Comparative Example 4 | Comparative Example 5 | Comparative Example 6 |
|---|---|---|---|---|---|---|---|
| Softening agent | Type of Softening agent 1 | Softening agent C | Softening agent G | Softening agent C | Softening agent D | Softening agent B | Softening agent E |
| | Amount (part) of Softening agent 1 | 10 | 10 | 5 | 5 | 10 | 5 |
| | Type of Softening agent 2 | | | Softening agent G | Softening agent G | | Softening agent G |
| | Amount (part) of Softening agent 2 | | | 5 | 5 | | 5 |
| Characteristics of colored resin particles and toner | Volume average particle diameter Dv (μm) | 7.5 | 7.5 | 7.5 | 7.5 | 7.5 | Fusion upon production |
| | Particle size distribution (Dv/Dn) | 1.15 | 1.13 | 1.13 | 1.13 | 1.12 | |
| | Softening temperature Ts (° C.) | 59 | 62 | 60 | 60 | 65 | |
| | Flow starting temperature Tfb (° C.) | 85 | 106 | 98 | 100 | 100 | |
| | Glass transition temperature (° C.) | 48 | 53 | 49 | 49 | 54 | |
| Toner Evaluation | Shelf stability (%) | 2.0 | 0.1 | 4.0 | 5.0 | 0.1 | — |
| | Minimum fixing temperature (° C.) | 150 | 165 | 160 | 150 | 160 | — |
| | Hot offset temperature (° C.) | 160 | 230< | 200 | 220 | 230< | — |
| | Gloss 170° C. | 9.0 | 4.1 | 6.3 | 6.0 | 4.0 | — |
| | 180° C. | 9.6 | 4.5 | 6.8 | 6.5 | 4.5 | — |
| | 190° C. | 9.4 | 3.4 | 7.1 | 6.8 | 5.0 | — |
| | 200° C. | 8.5 | 3.0 | 6.6 | 7.3 | 4.7 | — |

6. Toner Evaluation

Hereinafter, the evaluation results of the toner for developing electrostatic images will be reviewed with reference to Tables 1 and 2.

First, the toner of Comparative example 1 will be reviewed. From the evaluation results described in Tables 1 and 2, it can be understood that the toner of Comparative example 1 is a toner produced using 10 parts by mass of softening agent C (1,4-butanediol distearate) having an acid value of 0.1 mg KOH/g and a hydroxyl group value of 3.2 mg KOH/g. From the evaluation results described in Table 2, it can be understood that the toner of Comparative example 1 has a softening temperature "Ts" of 59° C., a flow starting temperature "Tfb" of 85° C. and a glass transition temperature of 48° C. in a flow tester.

From the evaluation results described in Table 2, it can be understood that the toner of Comparative example 1 has an aggregated toner ratio of 2.0 mass % and a gloss value of 8.5 to 9.6 at each temperature in the range from 170 to 200° C. Therefore, the toner of Comparative example 1 has no problem with at least shelf stability and glossy appearance.

However, the toner of Comparative example 1 has a high minimum fixing temperature of 150° C. and a low hot offset temperature of 160° C. In particular, the hot offset temperature of the toner of Comparative example 1 is the lowest value among the toners of Examples 1 to 5 and Comparative examples 1 to 5. Therefore, it can be understood that the toner of Comparative example 1 using only 1,4-butanediol distearate as a softening agent, in which $R^1$ is a tetramethylene group in the above general formula (1), is inferior both in low-temperature fixability and hot offset resistance, and is particularly inferior in hot offset resistance.

Next, the toner of Comparative example 2 will be reviewed. From the evaluation results described in Table 2, it can be understood that the toner of Comparative example 2 is a toner produced using 10 parts by mass of softening agent G (glycerin ester compound) having an acid value of 0.5 mg KOH/g and a hydroxyl group value of 4.8 mg KOH/g. From the evaluation results described in Table 2, it can be understood that the toner of Comparative example 2 has a softening temperature "Ts" of 62° C., a flow starting temperature "Tfb" of 106° C. and a glass transition temperature of 53° C. in a flow tester.

From the evaluation results described in Table 2, it can be understood that the toner of Comparative example 2 has an aggregated toner ratio of 0.1 mass % and a hot offset temperature of more than 230° C. Therefore, the toner of Comparative example 2 has no problem with at least shelf stability and hot offset resistance.

However, the toner of Comparative example 2 has a high minimum fixing temperature of 165° C., and a low gloss value of 3.0 to 4.5 at each temperature in the range from 170 to 200° C. In particular, the minimum fixing temperature of the toner of Comparative example 2 is the highest value among the toners of Examples 1 to 5 and Comparative examples 1 to 5. Also, the gloss value of the toner of Comparative example 2 is the lowest value at each temperature in the range from 180 to 200° C. among the toners of Examples 1 to 5 and Comparative examples 1 to 5. Therefore, it can be understood that the toner of Comparative example 2 using only softening agent G as a softening agent, and having a flow starting temperature "Tfb" of more than 100° C. in a flow tester is particularly inferior in low-temperature fixability and glossy appearance.

Next, the toner of Comparative example 3 will be reviewed. From the evaluation results described in Tables 1 and 2, it can be understood that the toner of Comparative example 3 is a toner produced using 5 parts by mass of softening agent C (1,4-butanediol distearate) and 5 parts by mass of softening agent G (glycerin ester compound). From the evaluation results described in Table 2, it can be understood that the toner of Comparative example 3 has a softening temperature "Ts" of 60° C., a flow starting temperature "Tfb" of 98° C. and a glass transition temperature of 49° C. in a flow tester.

From the evaluation results described in Table 2, it can be understood that the toner of Comparative example 3 has a hot offset temperature of 200° C. Therefore, the toner of Comparative example 3 has no problem with at least hot offset resistance.

However, the toner of Comparative example 3 has a high aggregated toner ratio of 4.0 mass %, a high minimum fixing temperature of 160° C. and a low gloss value of 6.3 to 7.1 at each temperature in the range from 170 to 200° C. Therefore, it can be understood that the toner of Comparative example 3 using, as softening agents, both 1,4-butanediol distearate and softening agent G is inferior in shelf stability, low-temperature fixability and glossy appearance.

The toner of Comparative example 4 will be reviewed. From the evaluation results described in Tables 1 and 2, it can be understood that the toner of Comparative example 4 is a toner produced using 5 parts by mass of softening agent D (1,6-hexanediol distearate) having an acid value of 0.1 mg KOH/g and a hydroxyl group value of 3.5 mg KOH/g, and 5 parts by mass of softening agent G (glycerin ester compound). From the evaluation results described in Table 2, it can be understood that the toner of Comparative example 4 has a softening temperature "Ts" of 60° C., a flow starting temperature "Tfb" of 100° C. and a glass transition temperature of 49° C. in a flow tester.

From the evaluation results described in Table 2, it can be understood that the toner of Comparative example 4 has a hot offset temperature of 220° C. Therefore, the toner of Comparative example 4 has no problem with at least hot offset resistance.

However, the toner of Comparative example 4 has a high aggregated toner ratio of 5.0 massa, a high minimum fixing temperature of 150° C. and a low gloss value of 6.0 to 7.3 at each temperature in the range from 170 to 200° C. In particular, the aggregated toner ratio of the toner of Comparative example 4 is the highest value among the toners of Examples 1 to 5 and Comparative examples 1 to 5. Therefore, it can be understood that the toner of Comparative example 4 using, as softening agents, both softening agent G and 1,6-hexanediol distearate in which $R^1$ is a hexamethylene group in the above general formula (1) is inferior in shelf stability, low-temperature fixability and glossy appearance, and is particularly inferior in shelf stability.

Next, the toner of Comparative example 5 will be reviewed. From the evaluation results described in Tables 1 and 2, it can be understood that the toner of Comparative example 5 is a toner produced using 10 parts by mass of softening agent B (dipentaerythritol hexastearate) having an acid value of 0.1 mg KOH/g and a hydroxyl group value of 3.8 mg KOH/g. From the evaluation results described in Table 2, it can be understood that the toner of Comparative example 5 has a softening temperature "Ts" of 65° C., a flow starting temperature "Tfb" of 100° C. and a glass transition temperature of 54° C. in a flow tester.

From the evaluation results described in Table 2, it can be understood that the toner of Comparative example 5 has an aggregated toner ratio of 0.1 mass % and a hot offset temperature of more than 230° C. Therefore, the toner of Comparative example 5 has no problem with at least shelf stability and hot offset resistance.

However, the toner of Comparative example 5 has a high minimum fixing temperature of 160° C. and a low gloss value of 4.0 to 5.0 at each temperature in the range from 170 to 200° C. In particular, the gloss value of the toner of Comparative example 5 is the lowest value at each temperature in the range from 170 to 180° C., among the toners of Examples 1 to 5 and Comparative examples 1 to 5. Therefore, it can be understood that the toner of Comparative example 5 using only dipentaerythritol hexastearate as a softening agent is inferior in low-temperature fixability and glossy appearance, and is particularly inferior in glossy appearance.

Next, the toner of Comparative example 6 will be reviewed. From the evaluation results described in Tables 1 and 2, it can be understood that the toner of Comparative example 6 is a toner produced using 5 parts by mass of softening agent E (distearyl succinate) having an acid value of 0.1 mg KOH/g and a hydroxyl group value of 4.7 mg KOH/g, and 5 parts by mass of softening agent G (glycerin ester compound). However, the toner of Comparative example 6 was fused upon the toner production. Therefore, the toner was not evaluated.

On the other hand, from the evaluation results described in Tables 1 and 2, it can be understood that the toner of Examples 1 to 5 is a toner produced using softening agent A (ethylene glycol distearate) having an acid value of 0.1 mg KOH/g and a hydroxyl group value of 2.6 mg KOH/g, or softening agent F (ethylene glycol dibehenate) having an acid value of 0.1 mg KOH/g and a hydroxyl group value of 3.0 mg KOH/g. From the evaluation results described in Table 2, it can be understood that the toner of Examples 1 to 5 has a softening temperature "Ts" of 60 to 61° C., a flow starting temperature "Tfb" of 85 to 96° C. and a glass transition temperature of 50 to 52° C. in a flow tester.

From the evaluation results described in Table 2, it can be understood that the toner of Examples 1 to 5 has a low aggregated toner ratio of 2.0 mass % or less, a low minimum fixing temperature of 140° C. or less, a high hot offset temperature of 180° C. or more, and a high gloss value of 7.0 to 10.8 at each temperature in the range from 170 to 200° C.

Therefore, it can be understood that the toner of Examples 1 to 5 using, as a softening agent, ethylene glycol distearate in which $R^1$ is an ethylene group and each of $R^2$ and $R^3$ is a heptadecyl group having 17 carbons in the above general formula (1), or ethylene glycol dibehenate in which $R^1$ is an ethylene group and each of $R^2$ and $R^3$ is a heneicosyl group having 21 carbons in the above general formula (1); moreover, having a softening temperature "Ts" of 60 to 61° C., a flow starting temperature "Tfb" of 85 to 96° C. and a glass transition temperature of 50 to 52° C. in a flow tester has excellent heat-resistant shelf stability, low-temperature fixability and hot offset resistance, and provides a smooth printing surface and high-gloss (glossy appearance) printouts.

The toner of Example 1 using only softening agent A (ethylene glycol distearate) as a softening agent has a particularly-low aggregated toner ratio of 0.1 mass %, a particularly-low minimum fixing temperature of 130° C., and a particularly-high gloss value of 9.5 to 10.8 at each temperature in the range from 170 to 200° C.

The toner of Example 4 using 5 parts by mass of softening agent A (ethylene glycol distearate) and 5 parts by mass of softening agent G (glycerin ester compound) has a particularly-high hot offset temperature of more than 230° C.

Also, the toner of Example 5 using 5 parts by mass of softening agent F (ethylene glycol dibehenate) and 5 parts by mass of softening agent B (dipentaerythritol hexastearate) has a particularly-low aggregated toner ratio of 0.1 mass %, a particularly-high hot offset temperature of more than 230° C. and a particularly-high gloss value of 9.0 to 10.2 at each temperature in the range from 170 to 200° C.

The invention claimed is:

1. A toner for developing electrostatic images comprising a colored resin particle containing a binder resin, a colorant and a softening agent, and an external additive, wherein the colored resin particle contains a diester compound represented by the following general formula (1) as the softening agent, and a content of the diester compound is in the range from 1 to 15 parts by mass with respect to 100 parts by mass of the colored resin particle, the toner has a softening temperature "Ts" of 55 to 70° C., a flow starting temperature "Tfb" of 80 to 100° C. and a glass transition temperature of 40 to 70° C. in a flow tester, and the binder resin is not a polyester resin:

General formula (1)

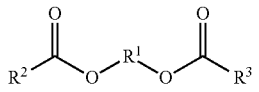

wherein, $R^1$ is an ethylene group or a trimethylene group; and each of $R^2$ and $R^3$ is independently a linear alkyl group having 11 to 25 carbons.

2. The toner for developing electrostatic images according to claim 1, wherein the colored resin particle further contains a dipentaerythritol hexaester compound as the softening agent.

3. The toner for developing electrostatic images according to claim 2, wherein the dipentaerythritol hexaester compound has a structure represented by the following general formula (2):

General formula (2)

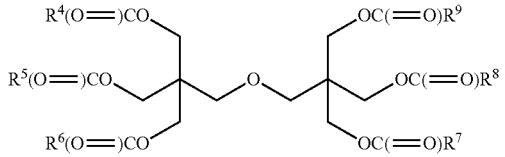

wherein, each of $R^4$ to $R^9$ is independently a linear alkyl group having 11 to 25 carbons.

4. The toner for developing electrostatic images according to claim 2, wherein a content ratio of the diester compound and the dipentaerythritol hexaester compound is in the range from 20: 80 to 80: 20 mass % (diester compound: dipentaerythritol hexaester compound).

5. The toner for developing electrostatic images according to claim 1, wherein the colored resin particle is produced by a wet method.

6. The toner for developing electrostatic images according to claim 1, wherein the softening agent has an acid value of 0.01 to 2 mg KOH/g.

7. The toner for developing electrostatic images according to claim 1, wherein the softening agent has a hydroxyl group value of 0.1 to 15 mg KOH/g.

8. The toner for developing electrostatic images according to claim 1, wherein the binder resin is a monovinyl monomer.

* * * * *